US007549186B2

(12) United States Patent
Geiberger

(10) Patent No.: US 7,549,186 B2
(45) Date of Patent: Jun. 23, 2009

(54) TOOTHBRUSH

(75) Inventor: Christoph Geiberger, Herne (DE)

(73) Assignee: GlaxoSmithKline Consumer Healthcare GmbH & Co., Buehl (Baden) (DE)

( * ) Notice: Subject to any disclaimer, the term of this patent is extended or adjusted under 35 U.S.C. 154(b) by 244 days.

(21) Appl. No.: 10/533,863

(22) PCT Filed: Nov. 5, 2003

(86) PCT No.: PCT/EP03/12434

§ 371 (c)(1),
(2), (4) Date: May 5, 2005

(87) PCT Pub. No.: WO2004/041023

PCT Pub. Date: May 21, 2004

(65) Prior Publication Data

US 2006/0010631 A1 Jan. 19, 2006

(30) Foreign Application Priority Data

Nov. 7, 2002 (GB) ..... 0226031.3
Feb. 14, 2003 (GB) ..... 0303468.3

(51) Int. Cl.
*A46B 9/04* (2006.01)

(52) U.S. Cl. ..... 15/167.1; 15/201

(58) Field of Classification Search ..... 15/167.1, 15/201; D4/105
See application file for complete search history.

(56) References Cited

U.S. PATENT DOCUMENTS

| | | | | |
|---|---|---|---|---|
| 1,323,042 | A | 11/1919 | Gardner | |
| 4,472,853 | A | 9/1984 | Rauch | |
| 4,520,526 | A * | 6/1985 | Peters | 15/167.1 |
| 4,864,676 | A | 9/1989 | Schaiper | |
| 5,499,421 | A | 3/1996 | Brice | |
| 5,802,656 | A * | 9/1998 | Dawson et al. | 15/110 |
| D436,446 | S | 1/2001 | Naslund | |
| D440,404 | S * | 4/2001 | Naslund | D4/104 |
| 6,353,958 | B2 * | 3/2002 | Weihrauch | 15/167.1 |
| 2001/0042280 | A1 * | 11/2001 | Moskovich et al. | 15/167.1 |

FOREIGN PATENT DOCUMENTS

| | | |
|---|---|---|
| BE | 897485 | 12/1983 |
| FR | 2548528 | 1/1985 |
| GB | 438091 | 11/1935 |
| WO | WO00/74522 | 12/2000 |
| WO | WO01/89344 | 11/2001 |

* cited by examiner

*Primary Examiner*—Laura C Guidotti
(74) *Attorney, Agent, or Firm*—Nora Stein-Fernandez; Theodore R. Furman

(57) ABSTRACT

A toothbrush head comprising three widthways adjacent sections in which the tip end of the middle section is enlarged into a bristle-carrying tip pad, there is an intermediate bristle-carrying pad between the tip pad and the base end of the head, with narrow link regions between the pads and the intermediate pad and the handle. The sections are connected to the toothbrush handle by flexible necks. The bristle distribution of a multi-section toothbrush head is thereby optimized.

16 Claims, 7 Drawing Sheets

10
11
12
13A
13B
14
15
16
17
18
19
20
21
22
23
151
152
153
L
T
3

13A
14
15
151
152
16
17
18
19
20
21
22
23

20
19
18
17
13A
22
21
23
151
152
153
3

Fig. 4A
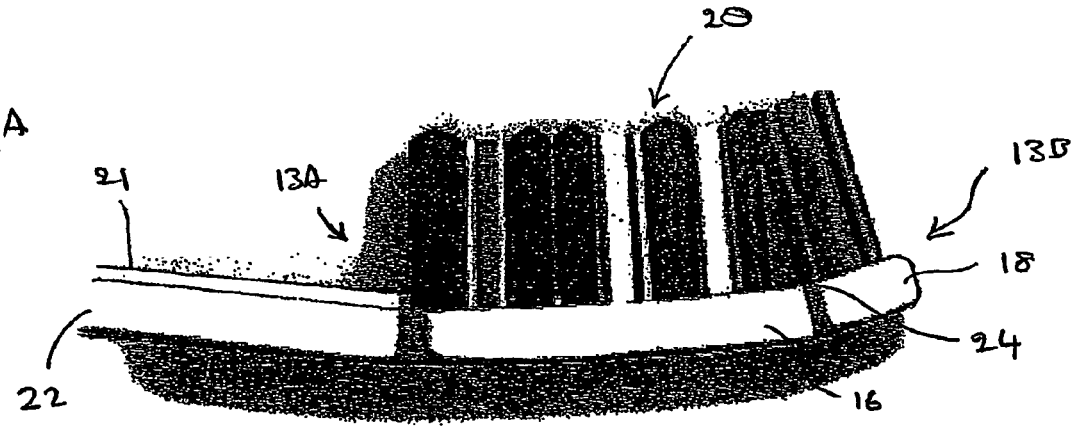
Fig. 4B
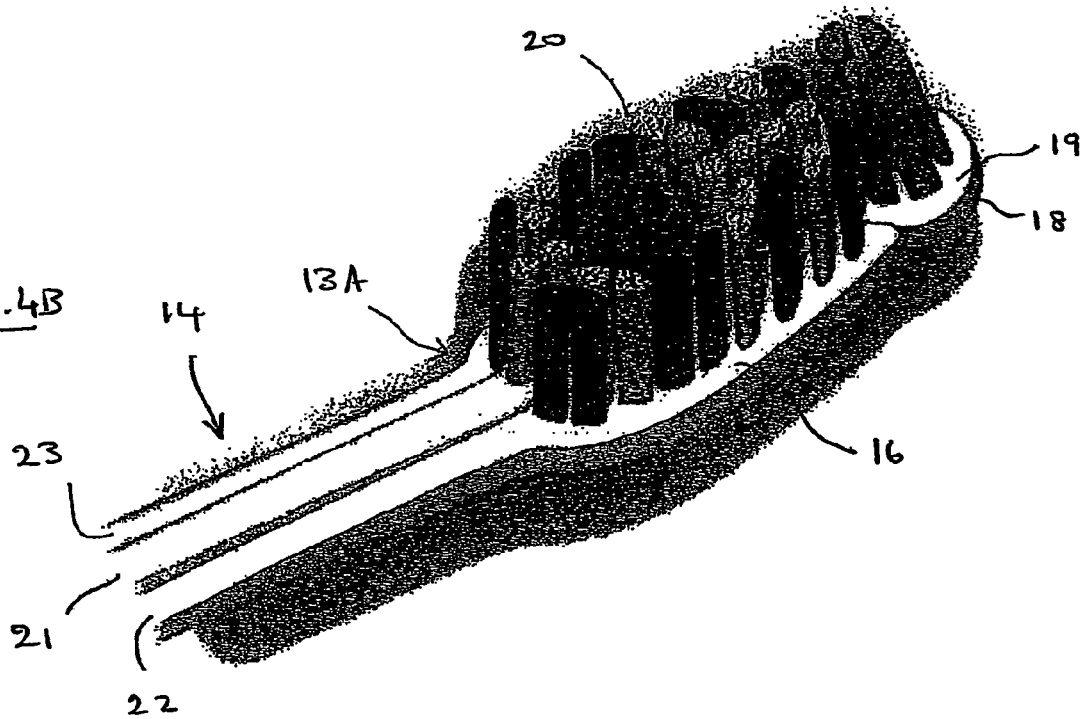
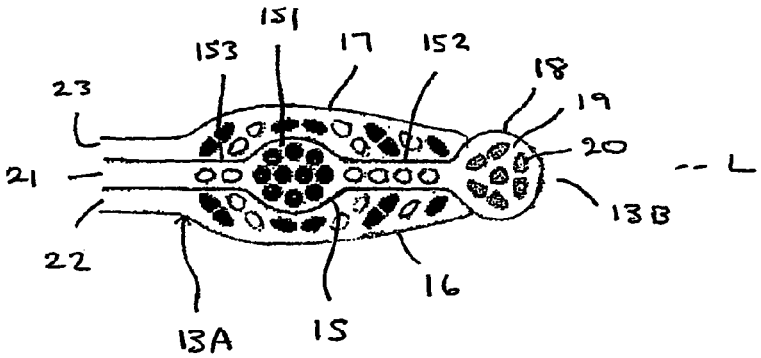
Fig. 4C

TOOTHBRUSH

This application is a 371 National Phase entry of international application PCT/EP03/012434 filed Nov. 5, 2003.

FIELD OF THE INVENTION

This invention relates to toothbrush heads, in particular to toothbrush heads comprising plural sections which can bend under the pressures of toothbrushing. The invention also relates to a toothbrush provided with such a head.

BACKGROUND OF THE INVENTION

Toothbrushes generally comprise a grip handle by which a user may hold the toothbrush and a bristle-carrying head, the head and handle being disposed along a longitudinal head-handle direction. Sometimes the head is replaceably connectable to the handle. Normally there is a neck between the head and the grip handle, being narrower than the adjacent part of the head and handle. The head has a tip end remote from the handle and a base end closest to the handle and the neck is joined to the head at the base end of the head. The junction between the base end of the head and the neck is generally marked by an inflexion point, i.e. a point of sharpest curvature between the head and the neck as seen in plan looking down along the bristles carried by the head, or alternatively by for example the edge of the pattern of bristle tufts closest to the handle.

In toothbrushes, as is well known, the head and grip handle are disposed so define a longitudinal direction (which need not be a straight line) between them, with a width direction perpendicular to this longitudinal direction. Bristles (the term encompasses other dental cleaning elements such as elastomer lamellae or fingers) extend from the head in a bristle direction generally perpendicular to the longitudinal and width directions. The head has a tip end furthest from the handle, and a longitudinally distanced base end closest to the handle and defined by he end of the bristle cluster and/or by an inflexion point in the shape of the head.

It is known to provide the head in the form of plural, particularly two or three, longitudinally elongate sections disposed widthways adjacent across the toothbrush head and being flexibly linked to the handle. A problem associated with known toothbrushes of this type is optimising the bristle distribution to improve cleaning.

For example U.S. Pat. No. 1,323,042 discloses a toothbrush head comprising three flexible sections, the middle section being widened to form a pad adjacent the tip of the head and which extends across the entire width of the toothbrush head adjacent to the tip end, but having a relatively narrow "stalk" linking this pad to the handle. US-D440,404 and US-D436,446 disclose toothbrushes with their heads comprising three sections, each linked to the grip handle by its own respective flexible neck, but each section being narrow relative to length. U.S. Pat. No. 4,864,676 discloses a head in the form of three sections comprising a middle section laterally flanked by two outer sections, the ends of the outer sections remote from the handle forming a partial ring around the end of the middle section, the middle section having bristles only in a small tuft at its end. U.S. Pat. No. 4,472,953 discloses a toothbrush comprising three widthways adjacent flexible necks each having a bristle carrying pad at its extremity remote from the handle, but this results in a head which is disproportionately wide relative to its length.

WO-A01/89344, FR-A-2548528 and U.S. Pat. No. 5,499,421 disclose heads comprising two such sections.

The purpose of such toothbrush heads comprising side by side sections flexibly linked to the handle so as to bend in response to toothbrushing pressures is to improve the ability of the head to adjust to the profile of the teeth, to improve the effectiveness of the head in reaching gaps between the teeth, particularly to achieve this improvement without application of excessive brushing pressures to the teeth, to distribute brushing pressures between the teeth and gums, and to allow a flow of water through the head so that the head may be thoroughly cleaned of for example excess toothpaste, debris etc. after use.

BRIEF SUMMARY OF THE INVENTION

It is an object of this invention to provide an improved toothbrush of the above-mentioned type, particularly aiming at providing an improved distribution of bristles on the head. Other objects and advantages of this invention will be apparent from the following description.

According to this invention a toothbrush head is provided, being connected or connectable at its base end to a toothbrush grip handle to thereby define a head-handle longitudinal direction, and comprising three widthways adjacent, longitudinally extending sections from which bristles extend, being a middle section and a lateral section on each widthways side of the middle section, one or more section being resiliently flexibly connected or connectable to the grip handle, characterised in that:— the end of the middle section adjacent to the tip end of the head is integrally widthways enlarged relative to the part of the middle section longitudinally adjacent nearer to the handle to provide a bristle-carrying pad adjacent to the tip end of the head and which extends across the entire width of the toothbrush head adjacent to the tip end, the middle section comprises an intermediate bristle-carrying pad, being a region of maximum width of the part of the middle section between the tip pad and the base end of the head, with a first link region of the section between the tip pad and the intermediate pad being narrower in width than the adjacent part of the tip pad and the intermediate pad, and a second link region of the section between the intermediate pad and the handle being narrower in width than the adjacent part of the intermediate pad.

DETAILED DESCRIPTION OF THE INVENTION

Preferably the head comprises only three such sections, i.e. a middle section and two lateral sections. Preferably two or more, preferably all of the sections, are resiliently flexibly connected to the grip handle so that the section may be resiliently bent out of a plane parallel to the longitudinal and width directions under the action of pressure on the bristles.

Preferably there is only one intermediate pad, only one first link region and only one second link region.

Typically the tip pad may be approximately of equal dimensions in the widthways and longitudinal directions, e.g. being approximately circular, semi-circular, rectangular or polygonal. Typically in its longitudinal direction such a tip pad may have a length of ca. 10-50%, e.g. 20-30% of the toothbrush head between its base and tip ends.

Typically such a tip pad may be of a size suitable to carry a polygonal cluster of bristles, typically disposed in plural tufts containing plural bristles and extending in a bristle direction generally perpendicular to the longitudinal and width directions. Typically the tip pad is large enough to carry 4-10 tufts of bristles of the typical size of toothbrush bristle tufts e.g.

tufts of 1-2 mm diameter or greatest sectional dimension. A suitable arrangement of tufts is a polygon of 5-8 tufts surrounding one or more central tuft.

The bristle carrying surface of the middle section may be substantially planar, or undulating, or may be curved e.g. concavely on the side on which the bristles are carried. Preferably the bristle-carrying surface of the tip pad may form an angle of 180° or less, e.g. 180°-160° with the surface, which may also be bristle carrying, of the adjacent part of the section closer to the handle, for example with the surface of the first link region. Similarly the bristle carrying surface of the lateral sections may be substantially planar, or undulating or may be curved e.g. concavely on the surface on which the bristles are carried.

In a preferred embodiment the tip pad extends longitudinally beyond the ends of the lateral sections remotest from the handle, typically for a distance of ca. 15-30%, e.g. 18-25% e.g. 20+/−2% of the length of the toothbrush head between its base end and tip end. In this way the tip pad extends across the entire width of the toothbrush head adjacent to the tip end, i.e. for at least part of its longitudinal extension the tip pad is not flanked on either of its sides by a lateral section.

Preferably the ratio of the widths of the tip pad and intermediate pad are in the range 1:1.5 to 1.5:1, e.g. in the range 1:1.2 to 1.2:1. Preferably the tip pad is wider than the intermediate pad.

The intermediate pad may for example have a length 20-40%, e.g. ca 30+/−5% of the length of the toothbrush head between the tip end and the base end of the head. The intermediate pad is preferably located so that 50% or more, particularly preferably 75% or more, even more so 90% or more, preferably all of its bristle face is in the longitudinal half of the head furthest from the tip end of the head. For example the widest part of the intermediate pad may be closer to the base end of the head than to the tip end of the head, for example 20-40% of the distance from the base end of the head toward the tip end of the head.

The tip pad and intermediate pads may have bristle-bearing surfaces of substantially the same area, and/or may have thereon clusters of bristle tufts fitting within an envelope of substantially the same area. For example the bristle-bearing surfaces of the tip pad and intermediate pad may differ by no more than 20% in area.

The intermediate pad may for example be circular, oval or polygonal in plan as viewed down the bristle direction. Typically the intermediate pad is large enough to carry 4-12 tufts of bristles of the typical size of toothbrush bristle tufts e.g. tufts of 1-2 mm diameter or greatest dimension cut across the bristle direction. A suitable arrangement of tufts is a polygon of 5-10 tufts surrounding one or more central tuft, for example including 2-4 tufts of bristles in line across the intermediate pad. The first and second link regions may for example narrow such that they carry only one tuft of bristles across their width.

The middle section may consequently comprise longitudinally sequentially a widthways narrow region extending from the base end of the head toward the tip end of the head from the direction of the handle to comprise the second link region and enlarging widthways at a place intermediate between the base of the head and the tip pad to form the intermediate pad, a widthways narrow region extending from the intermediate pad toward the tip end of the head from the direction of the handle to comprise the first link region, and integrally enlarging widthways adjacent to the tip end of the head to form such a tip pad.

The junction between the tip pad or the intermediate pad and the adjacent first or second link region is preferably marked by an inflexion point, i.e. a point of sharpest curvature between the pad and link region as seen in plan looking down along the bristles carried by the head.

The length of the first link region between the tip pad and the intermediate pad may for example be longer than the length of the respective tip pad or intermediate pad, for example being in the range 1-1.5 of the length of the tip pad or intermediate pad.

The second link region is preferably between the intermediate pad and the base end of the head.

One or more section may be resiliently flexibly connected to the grip handle in various ways.

For example all the sections may be made of a resilient material integral with the grip handle of the toothbrush. For example two or more of the sections may be connected, e.g. integrally, to each other and/or to the toothbrush handle, at a part of the toothbrush remote from the tip end of the head.

Preferably at least one, preferably all, section(s) are connected to the grip handle by an integral resiliently flexible neck. Such a neck may be flexible, and/or the link between the neck and the section, or between the neck and the handle may be flexible. The resiliently, i.e. springy, flexible neck may be achieved by integral construction with the types of plastics materials commonly used for toothbrushes.

For example one or more, e.g. all of the sections may be respectively connected to the grip handle by means of a respective flexible neck. Such a neck may extend between the base end of the of the section, i.e. the end of the section remote from the tip end, and an end of the grip handle which is closest to the section. Typically in such a construction each section of the head may be connected to the grip handle by a respective neck being an integral extension of the section toward the handle. Such a neck may be approximately as long as the section, e.g. having a length in the range 0.4-1.5, preferably 0.5-0.75 of the length of the head section. Such dimensions are found to provide suitable resilience.

Such necks may have longitudinally parallel widthways adjacent sides. Alternatively and preferably the widthways adjacent sides may taper in their widthways spacing so as to be spaced apart with an air gap between them at their ends closest to the handle, but such that they, and/or the sections they are connected to are in contact at their ends closest to the tip. The angle of taper may be 0.5-5°.

There may be a flexible material, e.g. an elastomeric material, e.g. a thin flexible web of such a material, between widthways adjacent parts of such necks, e.g. adjacent to the ends of such necks closest to the grip handle.

Alternatively one or more, e.g. every sections may be flexibly connected, e.g. at the base end of the head, to a neck which extends to the grip handle.

One or more, e.g. all of the sections, may be flexible, for example incorporating resiliently flexible links between longitudinally or widthways adjacent regions of the section, for example between the tip pad and the first link region.

The widthways adjacent longitudinally extending sides of the sections may be straight linear or alternatively they may be of a complementary interlocking shape, e.g. a complementary sinuous or undulating shape.

Each section may carry bristles, which may for example be disposed in one or more longitudinally extending row of tufts of bristles. Bristles may extend in a direction at a perpendicular or non-perpendicular angle to the longitudinal and width directions.

One or more section may be resiliently flexible in a widthways outward and inward direction. To avoid excessive outward splay of a lateral section the middle and adjacent lateral section may be provided with abutment parts so that if a lateral section bends outwardly an abutment part of the lateral section abuts against an abutment part of the middle section to limit the extent to which the lateral section can move outwardly. For example an enlarged pad comprising the end of the middle section may have a concavity with an opening facing toward the grip handle and into which an abutment part of a lateral section may fit such that a surface of the concavity comprises a corresponding abutment part.

Between widthways adjacent sections there may be an air gap allowing relative movement of the adjacent sections. Alternatively widthways adjacent sections may be in contact, allowing sliding relative movement of the sections, for example in a relative direction perpendicular to both the longitudinal and widthways directions. There may be a flexible material, e.g. an elastomeric material, e.g. a thin flexible filling or web of such a material, between widthways adjacent sections.

Preferably at least one section, more preferably all sections, are adapted to carry bristles. For example the section(s) may be provided with bristle holes into which bristle tufts may subsequently be fixed. Alternatively bristle tufts may be embedded into the section(s) by a known process in which the ends of the tufts project into a mould cavity in which the section is made by injection moulding.

In a preferred form of the toothbrush of the invention:

all sections carry bristles and are integrally flexibly connected by a neck to the toothbrush handle, the bristle carrying tip pad adjacent to the tip end of the head has a length of ca. 20-30% of the toothbrush head between its base and tip ends, the tip pad extends longitudinally beyond the ends of the lateral sections remotest from the handle, and extends across the entire width of the toothbrush head adjacent to the tip end, the middle section comprises a single intermediate bristle carrying pad being a region of maximum width of the part of the section between the tip pad and the base end of the head, from which tufts of bristles extend, and which is located entirely in the longitudinal half of the toothbrush head closest to the handle, and has a length of ca. 20-40% of the toothbrush head between its base and tip ends, a first link region of the section between the tip pad and the intermediate pad is narrower in width than the adjacent part of the tip pad and the intermediate pad, a second link region of the section between the intermediate pad and the neck is narrower in width than the adjacent part of the intermediate pad, the bristle carrying surface of the tip pad forming an angle of 180° or less with the surface of the first link region.

As seen in plan looking along the bristle direction the middle section comprising the tip pad, first link region and intermediate pad consequently has a so called "dumb bell" shape.

The preferred construction provides that on the middle section the bristle tufts are concentrated on the tip pad and intermediate pad, e.g. with 60% or more, e.g. 60-80% of the bristle tufts located on the tip and intermediate pads, and the residue of tufts making up to 100% on the link regions.

In this preferred construction the two pads, i.e. the tip and intermediate pad are longitudinally separated by a distance corresponding approximately to the surfaces of the teeth, and therefore provide improved cleaning efficacy. Such a distance may for example be 1-2 cm between the centres of the tip and intermediate pads.

The toothbrush head of this invention may be integrally made of a resiliently flexible plastic material such as polypropylene, polystyrene etc., as well known for toothbrush manufacture. The plastics material may be selected to optimise resilience of the section and/or neck and for example a relatively stiff plastic, e.g. a fibre-reinforced plastics material, e.g. polyester fibre-reinforced polypropylene, may be used. The section(s) and neck(s) may be integrally made of such plastic material with the grip handle.

The grip handle may be made of a plastic material such as the above, or may also comprise grip-enhancing parts of an elastomeric material, of a generally known type.

BRIEF DESCRIPTION OF THE DRAWING

The invention will now be described by way of example only with reference to the accompanying drawings which show:

FIG. 4 Shows a view of a toothbrush head of this invention in perspective, side and plan view.

Figures 1, 1A, 1D, 1E:
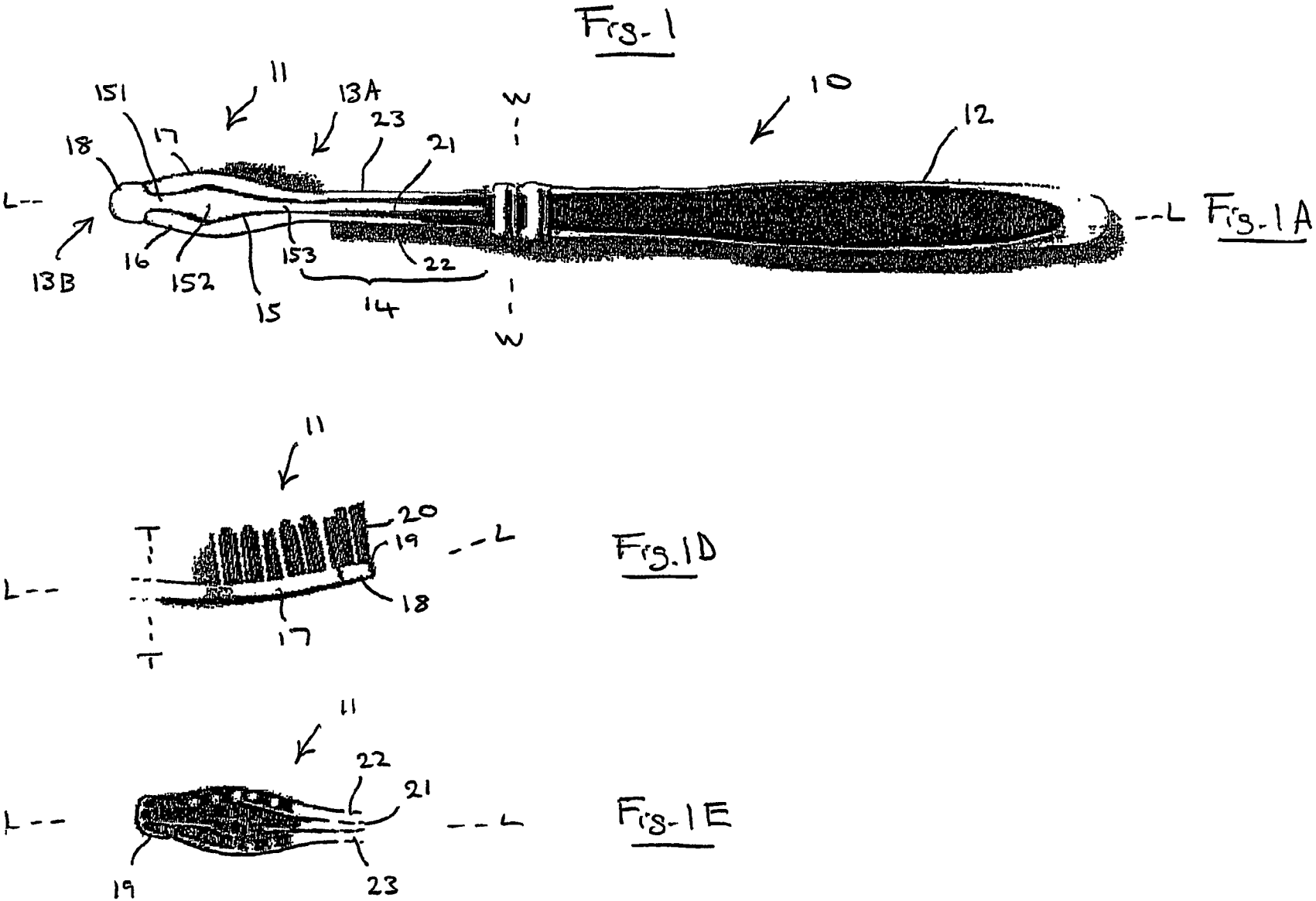
FIG. 1 Shows a view of a toothbrush head of this invention in perspective underside, side and plan view.

Parts numbered as below are shown in these figures:

10 toothbrush overall
11 toothbrush head overall
12 grip handle
13A base end of head
13B tip end of head
14 integral neck region
15 middle section
151 first link region
152 intermediate pad
153 second link region
154 concavity
16, 17 lateral sections
18 tip pad
19 bristle carrying surface of tip pad
20 bristles
21, 22, 23 necks
24 fold line
25 gaps between necks
26 bristle holes
30 elastomeric grip pad
31 elastomer material Referring to FIG. 1 a toothbrush 10 is shown overall (FIG. 1A), with a head 11 which is shown overall in a perspective plan view (FIG. 1B) perspective underside view (FIG. 1C), side (FIG. 1D) and plan (FIG. 1E) views. The toothbrush head 11 extends integrally toward a grip handle 12, the head 11 and grip handle 12 being disposed along a longitudinal direction L-L, having a width direction W-W perpendicular to the longitudinal direction and having a thickness dimension T-T. The head 11 has a base end 13A, being the end of the bristle pattern, nearest to grip handle 12 and a tip end 13B. Longitudinally between the base end 13A of head 11 and handle 12 is an integral neck region 14.

The head 11 is divided into three widthways adjacent sections 15, 16, 17 being a middle section 15 flanked on each widthways side by two lateral sections 16, 17. Each section 15, 16, 17 is elongated parallel to the longitudinal direction L-L. From a surface of each section 15, 16, 17 of head 11 extend bristles 20 in a bristle direction B perpendicular to the width direction W-W.

The middle section 15 is widthways enlarged at its end furthest from the handle 12 i.e. forming a tip pad 18. The surface 19 of tip pad 18 is of a size suitable to carry a polygonal cluster of tufts of bristles 20. The middle section 15 is enlarged at 152 into a widened part between the pad 18 and the base end, i.e. forming an intermediate pad. The widthways adjacent surfaces of the lateral sections 16, 17 are correspondingly shaped. On the pad 152 tufts of bristles 20 are arranged widthways adjacent. FIG. 1D shows that the surfaces of the sections 15, 16, 17 from which the bristles 20 extend are gently concave curved in their longitudinal direction.

Between the tip pad 18 and intermediate pad 152 is a first link region 151, and between the intermediate pad 152 and the base end of the head 13 is a second link region 153. The surface 19 of the pad 18 forms an angle of 180° with the surface of the adjacent part of link region 151.

Figure 1B:
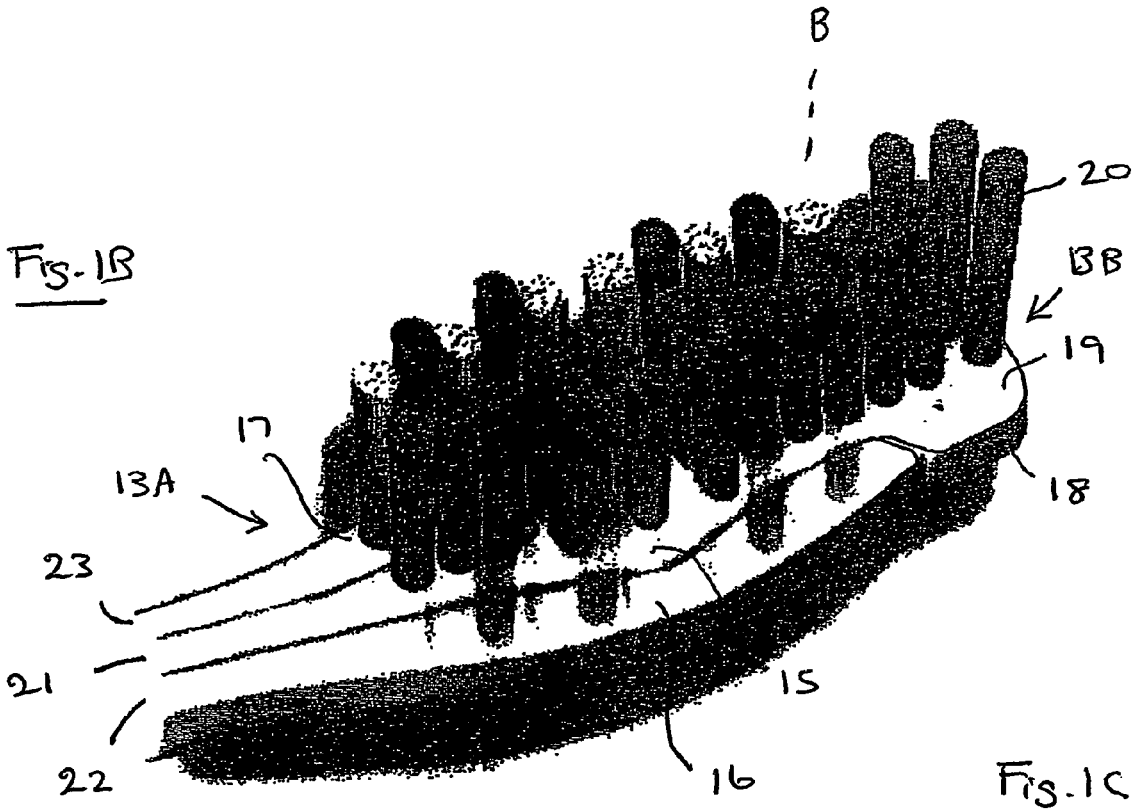
Figure 1C:
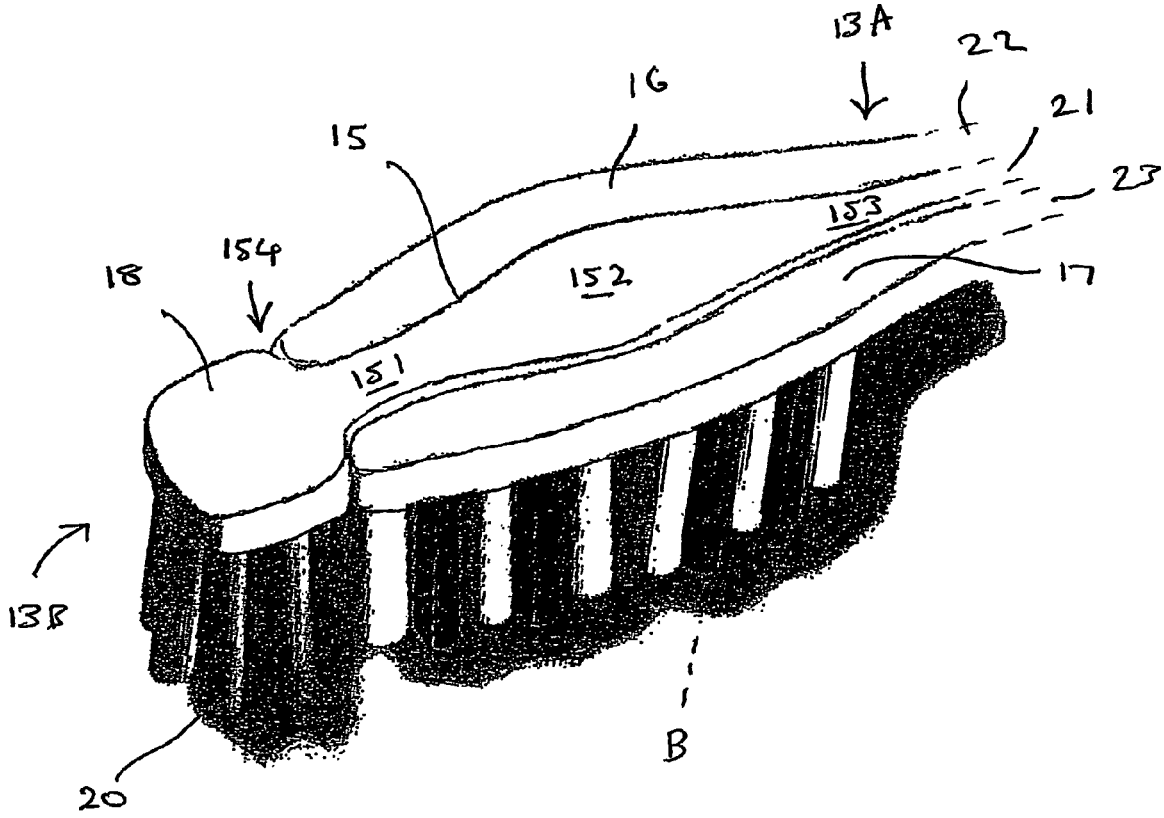

The junction between the base end 13 of the head and the neck 14 as seen in the plan views FIGS. 1B and 1E is distinguished by an inflexion point of greatest curvature.

The bristles 20 are disposed in discrete tufts. As shown in FIG. 1 the tufts are arranged in rows extending generally widthways across the head, and rows extending generally longitudinally along each section 15, 16 17.

At the base end 13 of the head 11 each of the three sections 15, 16, 17 is integrally formed into a respective neck 21, 22, 23 by which the section is connected to the grip handle 12. Each neck 21, 22, 23 is made of resiliently flexible plastic material so that the neck 21, 22, 23 flexibly and resiliently links its section 15, 16, 17 to the grip handle 12. The length of each neck 21, 22, 23 is approximately the same as the length of the section 15, 16, 17, but may be varied to suit requirements.

The grip handle 12 is of generally conventional construction and design, and incorporates an elastomeric grip pad 30 introduced into a cavity (not shown) in handle 12 by a conventional process of injection moulding.

Referring to FIGS. 2-5, alternative constructions of the toothbrush head of this invention are shown.

Figures 2, 2A:
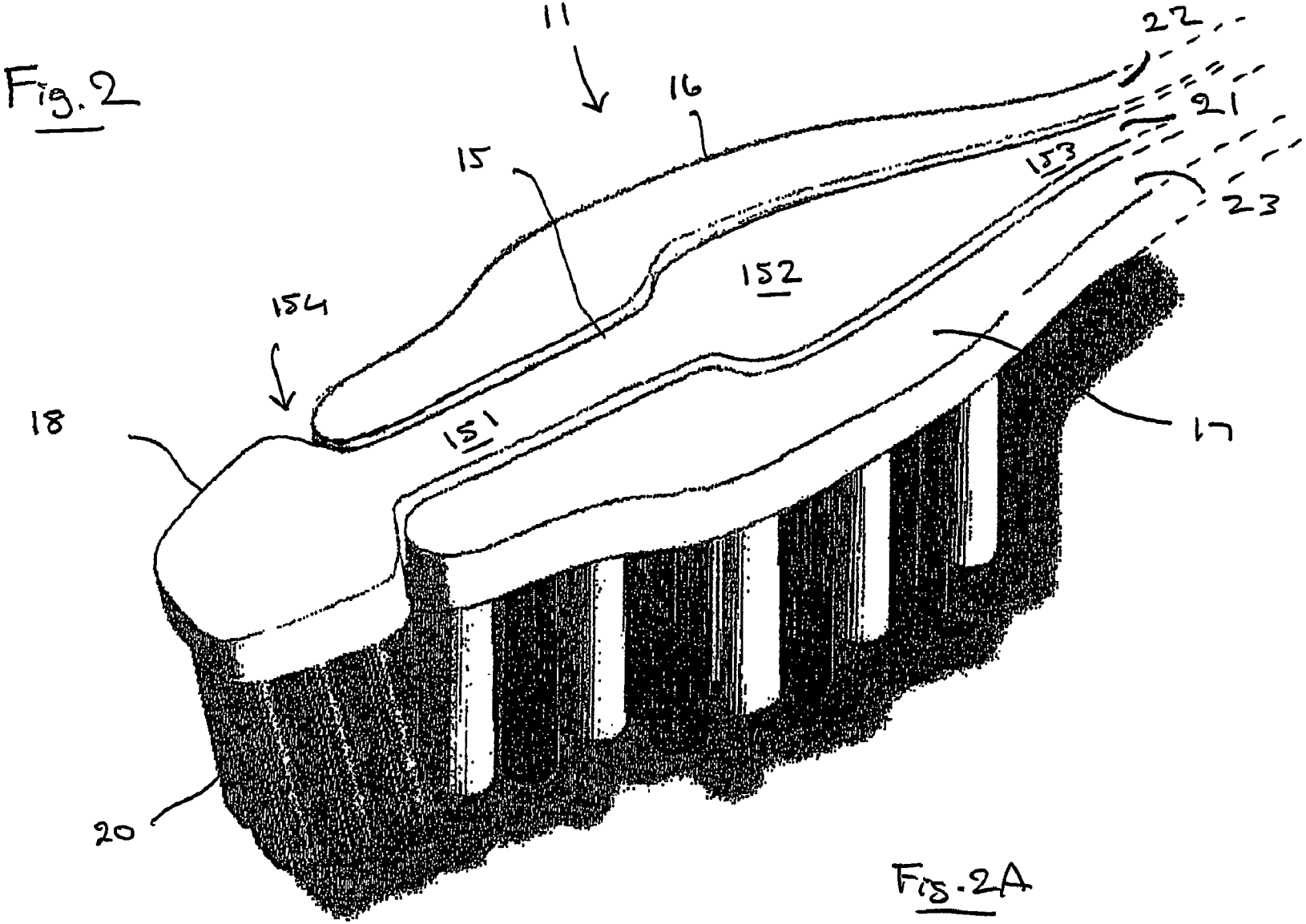
FIG. 2 Shows a view of another toothbrush head of this invention in perspective underside, side and plan view.
Figures 2, 2B, 2C, 2D, 2E:
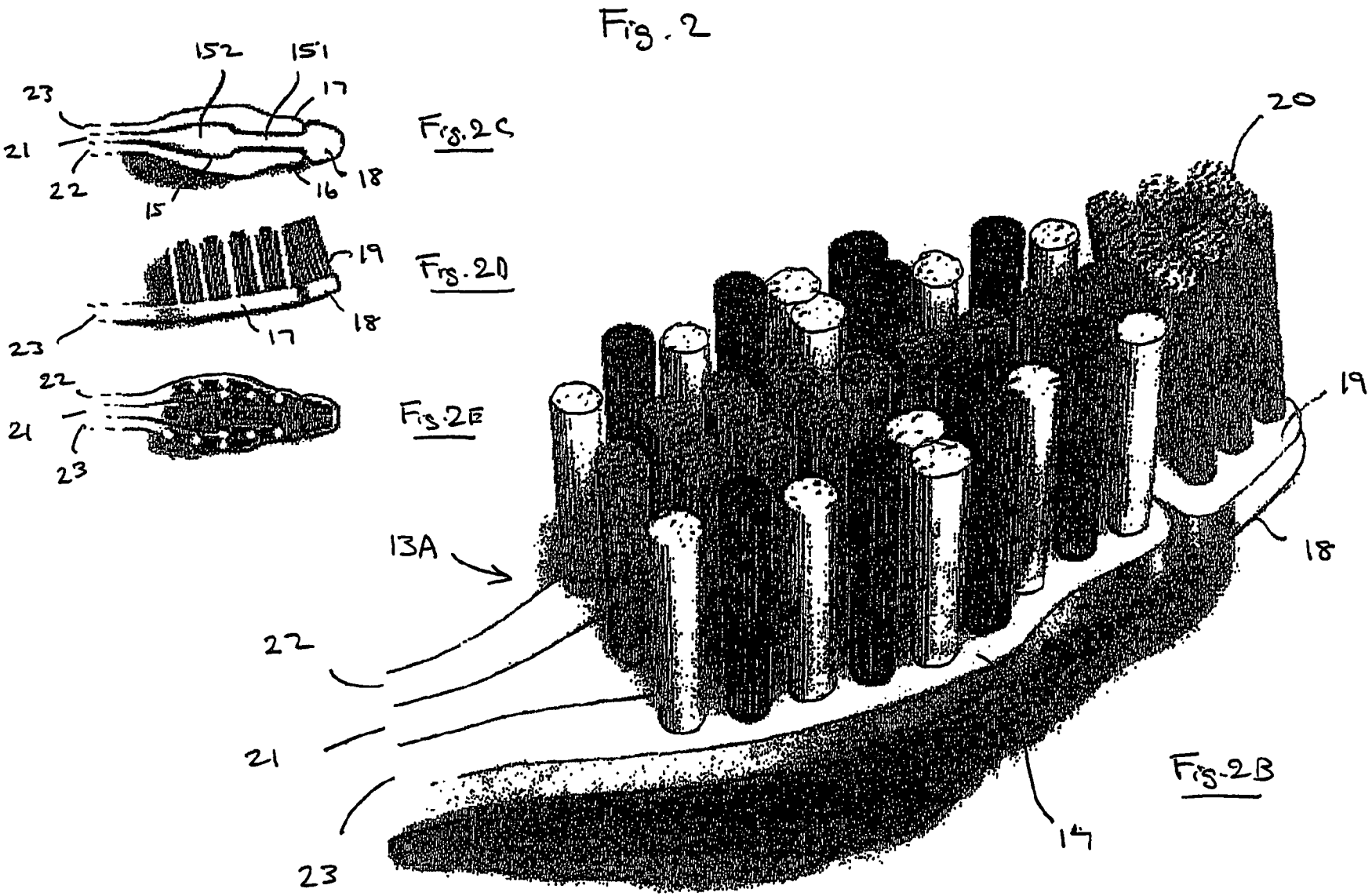

In FIG. 2 a head similar to that of FIG. 1 is shown enlarged in perspective (FIGS. 2A, 2B), and in underside (FIG. 2C), side (FIG. 2D) and plan (FIG. 2E) views. It is seen that the middle section 15 has a widened intermediate pad 152 occupying the longitudinal half of section 15 closer to the handle, and a narrower first link region 151 between pad 152 and tip pad 18. Also, which may be independent of other features of FIG. 2, the face 19 of pad 18, from which bristles extend, forms an angle less than 180° with the adjacent face of first link region 151. In FIG. 2 the pad 18 is polygonal, approximately pentagonal, in plan. A second link region 153 links the intermediate pad 152 to the neck 21.

Figures 3, 3A, 3B, 3C, 3D:
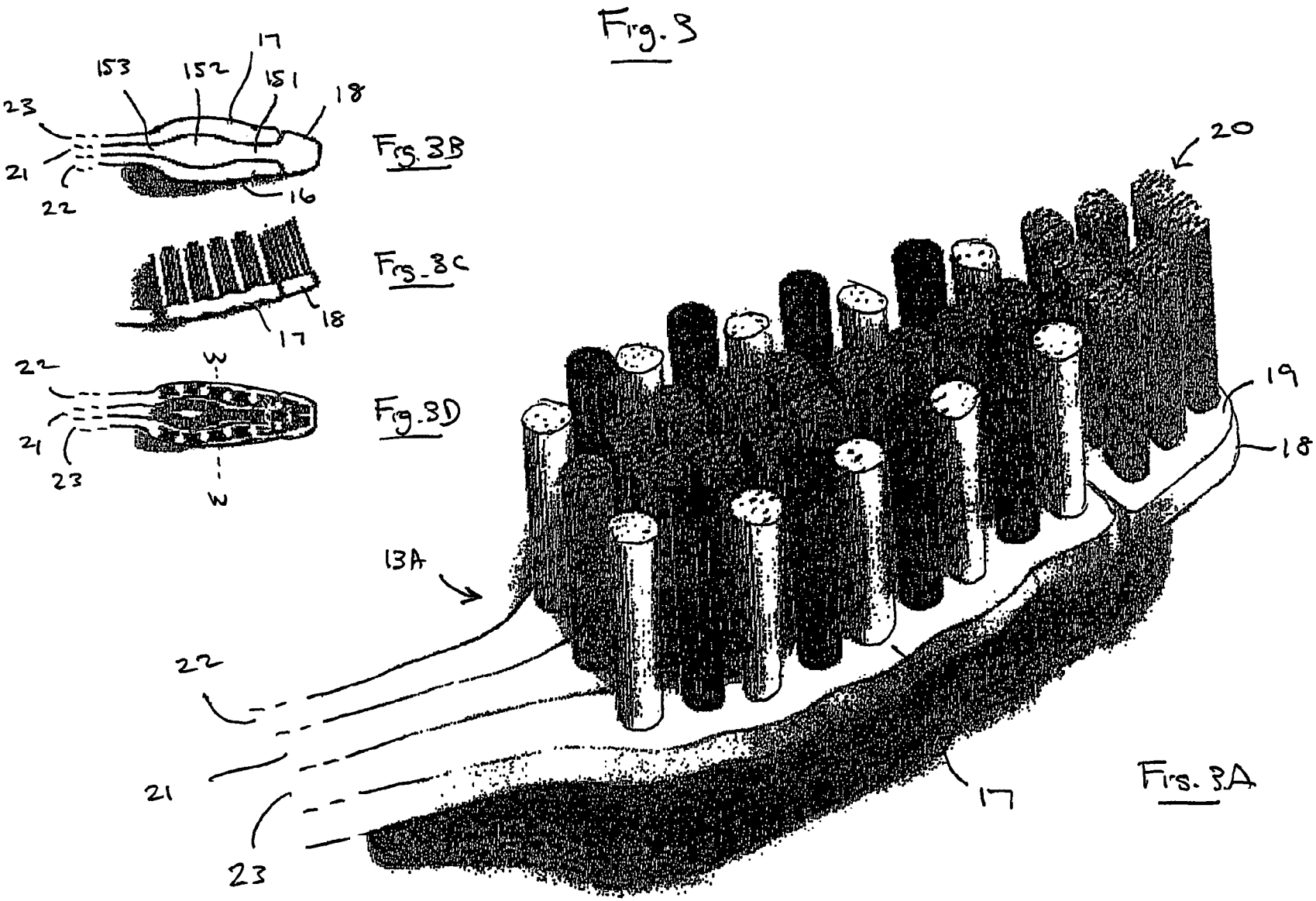
FIG. 3 Shows a view of another toothbrush head of this invention in perspective underside, side and plan view.

In FIG. 3 (FIG. 3A perspective plan view, FIG. 3B underside view, FIG. 3C side view, FIG. 3D plan view) a similar construction is shown, except that the face 19 of tip pad 18, from which bristles extend is coplanar with the adjacent first link region 151 from which bristles extend. Again the middle section 15 is widened between the link regions to form an intermediate pad 15B. Also, independently of this, bristle surfaces 21 of the lateral section 16, 17 are of undulating shape as viewed in the width direction W-W.

In FIG. 4 a head similar to that of FIG. 1 is shown enlarged in side view FIG. 4A, perspective FIG. 4B, and in plan view FIG. 4C. It is seen that the middle section 15 has an end adjacent to the tip end of the head integrally enlarged to form a bristle-carrying tip pad 18 which extends across the entire width of the toothbrush head adjacent to the tip end 13A. This tip pad 18 is generally circular in plan, having in its longitudinal direction a length of ca. 20-30% of the toothbrush head between its tip end 13B and its base end 13A.

The tip pad 18 is of a size suitable to carry a polygonal cluster of tufts 20 in the form of a polygonal pattern of tufts around a central tuft. As seen in FIG. 4A the bristle carrying surface 19 of the tip pad 18 forms an angle of less than 180° with the surface of the adjacent first link region 152 of the middle section 15 closer to the handle, and the tip pad 19 extends longitudinally beyond the ends of the lateral sections 16, 17 remotest from the handle.

In the toothbrush head of FIG. 4 the middle section 15 comprises a single intermediate bristle carrying pad 151 being a region of maximum width of the part of the section 15 between the tip pad 18 and the base end 13A of the head, from which plural tufts of bristles 20 extend, being arranged in a polygonal cluster surrounding two central tufts. The intermediate pad 151 is oval in plan (except where interrupted by the link regions to be described) and has an area in plan similar to the tip pad 19. The intermediate pad 151 has a length ca. 20-30% of the length of the toothbrush head between the tip end 13B and the base end 13A of the head. The intermediate pad 151 is located within the longitudinal half of the head closest to the handle. The widest part of the intermediate pad 151 is closer to the base end 13 of the head than to the tip end 13B of the head.

There is an integral first link region 152 between the tip pad 18 and the intermediate pad 151 being narrower in width than the adjacent part of the tip pad 19 and the intermediate pad 151.

There is a second link region 153 between the intermediate pad 151 and the base end 13 of the head being narrower in width than the adjacent part of the intermediate pad 151, and integrally linked to neck 21. It is seen that there are inflexion points, i.e. of greatest curvature, defining the junctions between the pads 18, 151 and the link regions 152, 153. In FIG. 4 each of the link regions 152, 153 is parallel sided as seen in plan. The length of the first link region 152 between the tip pad 18 and the intermediate pad 151 is longer than the length of both the tip pad 18 and the intermediate pad 151.

It is seen that the majority of the bristle tufts 20 on the middle section 15 are located on the tip pad 18 and intermediate pad 151, i.e. as seen in FIG. 4C there are ten tufts on the intermediate pad 151, seven tufts on the tip pad 18, and six tufts on the link regions 152, 153.

Figure 5:
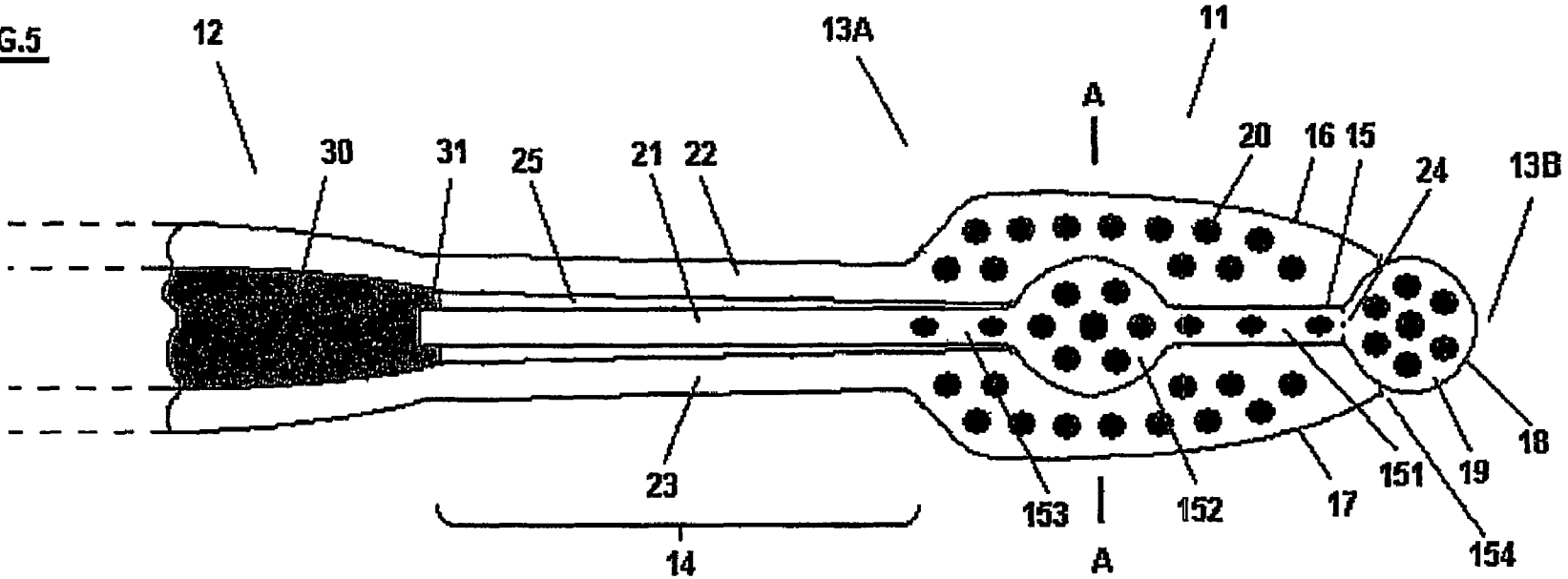
FIG. 5 Shows a schematic view of a toothbrush head of this invention in plan view.

Referring to FIG. 5, this shows in more detail a plan view of a preferred construction of toothbrush head 11 of this invention, with three sections 15, 16, 17 each of which is integrally linked to a respective neck 21, 22, 23 which is in turn integrally linked to the grip handle 12, of which the part closest to the head 11 is shown. It can be seen that the construction of head is similar to that of FIG. 4, i.e. with the middle section comprising a tip pad 18, an intermediate pad 151, a first link region 152 and a second link region 153. Bristles 20 are shown in a non-limiting representative pattern disposed on the sections of head 11.

The surface 19 of tip pad 18 forms an angle less than 180° with the adjacent surface of first link region 152 at the fold line 24. Tip pad 18 is approximately circular 7.5 mm in diameter. First link region 151 is ca. 9-10 mm long and 2-3 mm wide. Intermediate pad 152 is oval, ca. 9-10 mm long and 7-8 mm wide. Second link region 153 is ca. 5-7 mm long and ca. 2-3 mm wide. The thickness of the sections is ca. 3-4 mm. Necks 21, 22, 23 are ca. 23-25 mm long and 2-3 mm wide. The lateral necks 22, 23 are ca. 3-4 mm thick and middle neck 21 is slightly thicker, ca. 4-5 mm. The head 11 is overall of a generally oval shape tapering toward the tip end and has a total length ca. 30-32 mm, and a width at its widest point widthways adjacent intermediate pad 152 of ca. 13 mm i.e. conventionally sized. When made in these dimensions of typical plastics materials such as polypropylene, polyamide, ABS, fibre-reinforced polypropylene etc. suitable flexibility is achieved.

The gaps 25 between the necks 21, 22, 23 taper toward the tip end 13B, being ca. 0.5-1 mm at the end closest to the handle 12, and tapering such that the sections 15, 16, 17 are in sliding contact. Parts of the necks 21, 22, 23 adjacent to the base end 13A of the head 11 may also be in sliding contact. The handle 12 also incorporates an elastomeric grip pad 30, and the flexible elastomer material 31 extends into the gaps 25 adjacent to the handle 12.

It is seen in FIGS. 1-5 that as seen in plan view the outer envelope of the head 11 shows a shallow concavity at 154 longitudinally distanced from the tip end 13B, of a shape designed such that if pad 18 contacts a tooth surface and moves longitudinally in the base-tip direction a tooth or other oral tissue surface is unlikely to catch in the gap between the tip pad 18 and section 16 or 17, e.g. to thereby force the sections 15, 16, 17 apart. A smooth transition in this area of the envelope is desirable for this reason.

Figure 6:
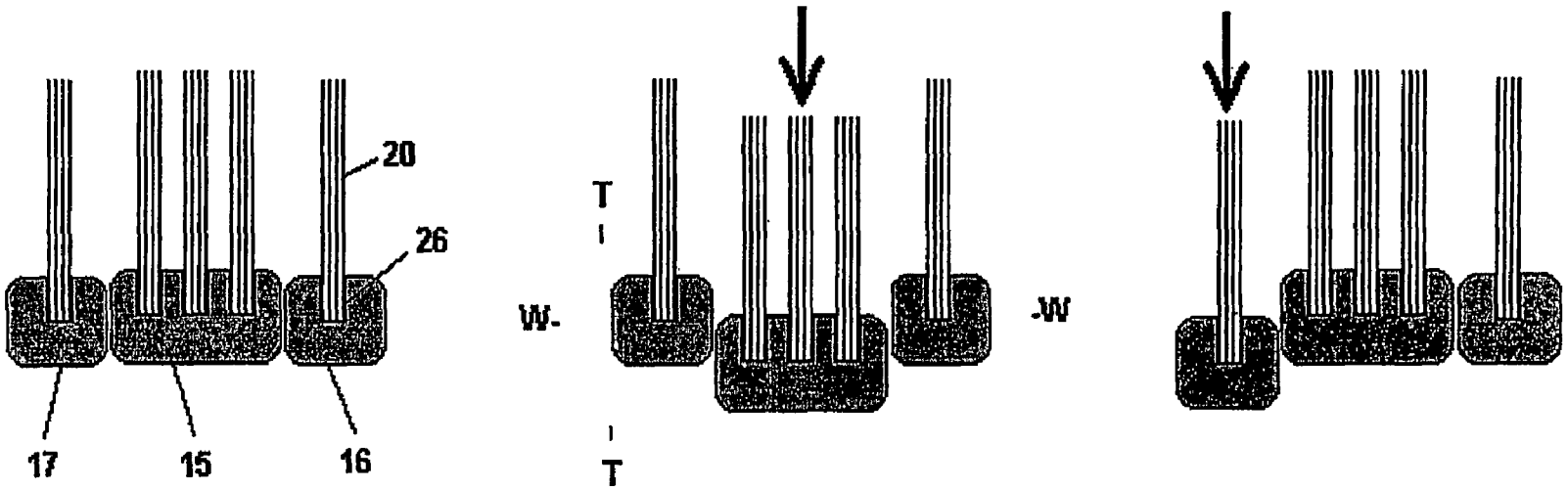
FIG. 6 shows cross sections through the head of FIG. 5.

Referring to FIG. 6, a cross section through the head 11 of FIG. 5 is shown, cut at line A-A of FIG. 5. It is seen how the bristles 20 are set in bristle holes 26 in the sections 15, 16, 17 or otherwise moulded into the head in a conventional manner. It is seen how under the action of pressure on the bristle, shown by the arrow, experienced during toothbrushing, the sections 15, 16, 17 can move resiliently out of a plane parallel to the longitudinal and width directions. In FIG. 6 the gap between the sections 15, 16, 17 is shown exaggerated for clarity, the sections 15,16,17 actually being in contact allowing relative sliding movement between widthways adjacent segments.

The invention claimed is:

1. A toothbrush having a head and a toothbrush grip handle, the head having a base end at which the head is connected to the toothbrush grip handle to thereby define a head-handle longitudinal direction, the head having a longitudinally opposite tip end and consisting of three widthways adjacent, longitudinally extending sections from which bristles extend, being a middle section and two lateral sections each being adjacent a widthways side of the middle section, each section having an end remote from the toothbrush grip handle, one or more of the sections being resiliently flexibly connected to the grip handle, between widthways adjacent sections being an air gap allowing relative movement of the sections, the middle section longitudinally sequentially consisting of:

a tip pad at an end of the middle section that is at the tip end of the head and integrally widthways enlarged relative to a longitudinally immediately adjacent part of the middle section longitudinally nearer to the handle, the tip pad having a bristle carrying surface carrying plural tufts of bristles, and which extends across the entire width of the toothbrush head adjacent to the tip end and having a length of 20-50% of the length of the toothbrush head between its base end and tip end, and extends longitudinally beyond ends of the two lateral sections remote from the toothbrush grip handle, longitudinally immediately adjacent to the tip pad closer to the handle and integral with the tip pad is a single first link region of the middle section relative to which the tip pad is integrally widthways enlarged, longitudinally immediately adjacent to the first link region and closer to the handle than the tip pad is a single region of the middle section which is integrally widthways enlarged relative to the first link region to provide a single intermediate bristle-carrying pad having a bristle carrying surface which carries plural tufts of bristles, and being a region of maximum width of the pad of the middle section between the tip pad and the base end of the head, and having a length of 20-40% of the length of the middle section between the tip end of the head and the base end of the head and having 50% or more of its length in the longitudinal half of the toothbrush head closest to the handle, longitudinally immediately adjacent to the intermediate bristle-carrying pad and integral with the intermediate bristle-carrying pad is a single second link region of the middle section relative to which the intermediate bristle-carrying pad is integrally widthways enlarged, longitudinally immediately adjacent to the second link region and integral therewith being an integral resiliently flexible neck connecting the middle section to the toothbrush grip handle.

2. A toothbrush according to claim 1 characterised in that two or more, of the middle section and lateral sections are resiliently flexibly connected to the grip handle so that the section may be resiliently bent out of a plane parallel to the longitudinal and width directions under the action of pressure on the bristles.

3. A toothbrush according to claim 1 characterised in that the bristle carrying surface of the tip pad forms an angle of 180°-160° with a surface of the adjacent part of the first link region.

4. A toothbrush according to claim 1 characterised in that the tip pad extends longitudinally beyond the ends of the lateral sections remotest from the handle for a distance of 15-30% of the length of the toothbrush head between its base end and tip end.

5. A toothbrush according to claim 1 characterised in that the intermediate pad is located so that all of its bristle face is in the longitudinal half of the head furthest from the tip end of the head.

6. A toothbrush according to claim 5 characterised in that widthways adjacent sections are in contact allowing sliding relative movement of the sections.

7. A toothbrush according to claim 1 characterised in that widthways adjacent sections are in contact allowing sliding relative movement of the sections.

8. A toothbrush according to claim 1 characterised in that all of the sections are respectively connected to the grip handle by means of a respective flexible neck which extends between the base end of the of the section and an end of the grip handle which is closest to the section.

9. A toothbrush according to claim 8 characterised in that each section of the head is connected to the grip handle by a respective neck being an integral extension of the section toward the handle, and the neck has a length in the range 0.4-1.5 of the length of the head section.

10. A toothbrush according to claim 9 characterised by an elastomeric material between widthways adjacent parts of necks.

11. A toothbrush according to claim 8 characterised in that the middle and lateral sections have widthways adjacent sides which taper in their widthways spacing so as to be spaced apart with an air gap between them at their ends closest to the handle, such that middle and lateral sections are in contact at their ends closest to the tip end.

12. A toothbrush according to claim 9 characterised in that the middle and lateral sections have widthways adjacent sides which taper in their widthways spacing so as to be spaced apart with an air gap between them at their ends closest to the handle, such that middle and lateral sections are in contact at their ends closest to the tip end.

13. A toothbrush according to claim 1 characterised in that the tip and intermediate pad are longitudinally separated by a distance 1-2 cm between the centres of the tip and intermediate pads.

14. A toothbrush according to claim 13 made of a fibre-reinforced plastics material.

15. A toothbrush according to claim 1 made of a fibre-reinforced plastics material.

16. A toothbrush according to claim 15 made of polyester fibre-reinforced polypropylene.

* * * * *